United States Patent [19]

Hooker

[11] 4,374,626

[45] Feb. 22, 1983

[54] ERASING TYPEWRITER WITH AUTOMATIC/MANUAL SELECTION

[75] Inventor: Robert W. Hooker, Lexington, Ky.

[73] Assignee: IBM Corporation, Armonk, N.Y.

[21] Appl. No.: 141,737

[22] Filed: Apr. 18, 1980

Related U.S. Application Data

[63] Continuation-in-part of Ser. No. 116,733, Jan. 30, 1980, abandoned.

[51] Int. Cl.[3] ..... B41J 29/16

[52] U.S. Cl. ..... 400/697.1; 400/279; 400/696

[58] Field of Search ..... 400/279, 696, 697.1

[56] References Cited

U.S. PATENT DOCUMENTS

| | | | |
|---|---|---|---|
| 3,724,633 | 4/1973 | Korb et al. | 400/697.1 X |
| 3,780,846 | 12/1973 | Kolpek et al. | 400/697.1 X |
| 4,245,918 | 1/1981 | Bowles et al. | 400/697.1 |
| 4,252,451 | 2/1981 | Clancy et al. | 400/697.1 X |
| 4,264,226 | 4/1981 | Bowles et al. | 400/697.1 X |

*Primary Examiner*—Ernest T. Wright, Jr.
*Attorney, Agent, or Firm*—Pollock, Vande Sande & Priddy

[57] ABSTRACT

An automatic erasing typewriter determines, in response to actuation of an erase key, if automatic erasing is possible. If not, the typewriter terminates the erase cycle with a backspace and conditions the typewriter for manual erase. Actuation of a character key as the next actuated key completes the manual erase. Actuation of a key other than a character key deconditions the manual erase.

7 Claims, 5 Drawing Figures

ERASING TYPEWRITER WITH AUTOMATIC/MANUAL SELECTION

CROSS REFERENCE TO RELATED PATENTS AND APPLICATIONS

This is a continuation-in-part of co-pending application Ser. No. 116,733 filed Jan. 30, 1980, now abandoned in favor of this application. Reference is made to U.S. Pat. Nos. 3,724,633 and 3,780,846, and to copending Bowles et al applications Ser. No. 908,315 (LE977-014) entitled "Erase Through Tab" now U.S. Pat. No. 4,245,918, and Ser. No. 908,314, (LE977-016) entitled "Underscore Erase" now abandoned in favor of application Ser. No. 227,878, filed Jan. 23, 1981. The first mentioned patent discloses a typewriter with the capability of effectively erasing an individual character. The second mentioned patent discloses an automatic erasing typewriter in which the character which is erased is determined by signals stored in a line memory. The two referenced applications disclose improvements allowing the erase function to proceed through a tab, and to erase the underscore graphic of an underscored character.

FIELD OF THE INVENTION

The invention relates to improvements to electronic typewriters to allow both automatic and manual erase functions with a minimum amount of keying.

BACKGROUND OF THE INVENTION

The automatic erase feature, in which the typist need not key in an identification of the character to be erased (disclosed in the '846 patent), while considerably increasing keystroke efficiency, is, of course, only applicable where the line memory associated with the typewriter electronics includes identification of the character sought to be erased. In the event that the associated memory includes, at the print point at which the carriage is positioned, no erasable character, the typewriter leaves the erase mode and thus requires additional keystroking to effect the erasing action initially sought by depression of the erase key. In the event that the memory includes a code indicating a space function, the automatic erasing typewriter of the '846 patent will produce a backspace in response to the first erase depression and a second backspace to, in effect, search for an erasable character in the line memory, and when such character is found, it will be erased.

The first-mentioned patent teaches a manual erasing technique which serves to improve the keystroking efficiency over that available prior to that invention. This improvement required the operator to stroke a correction key with two effects; firstly, a backspace is performed to bring the print point and the type carrier into conjunction with the character sought to be erased, and the typewriter is conditioned such that on the next keystroke, rather than using the normal print ribbon, a special erase ribbon is interposed between the type carrier and the paper sheet when the type carrier next strikes the paper. Accordingly, when the operator next strokes a key, identical to the erroneously stroked key, the impression of that key is lifted off, or erased, from the paper. The operator can then strike the desired key to replace the erased character with the desired character.

In automatically erasing typewriters such as that disclosed in the '846 patent, the typewriter is only capable of automatically erasing a character when a code representing the character is retained in a (line) memory. Once the carriage is indexed (or carriage return is effected), the line memory is cleared and thereafter the automatic erase feature cannot be employed. Automatically erasing typewriters manufactured by IBM, however, are still capable of erasing a character even when (line) memory does not contain a representation of the erroneously typed character by simultaneously depressing the erase and "code" keys. This has the effect of backspacing the print point and on the next key depression, if a character key, the erase ribbon or medium is used to erase the character from the page. However, the operator must decide to use the code key when line memory is cleared in order to produce the desired result. This obviously places an added burden on the operator and will result in loss of keystroking efficiency if the operator's decision is incorrect.

The present invention seeks to improve operation of the automatically erasing typewriter in the event that the character sought to be erased is not contained in the line memory, and enables the automatically erasing typewriter to achieve the erasing function with a minimum amount of decision-making on the part of the operator. In accordance with the invention, the operator employs the same initial techniques regardless of whether or not the character sought to be erased is retained in the line memory. In particular, in accordance with the invention, the operator strokes the erase key which initiates the automatic erasing operation. In the event that the erroneously typed character is contained in the line memory, it is automatically erased as taught in the second referenced patent. In the event, however, that the erroneously typed character is not found in the line memory, signals are generated to condition the typewriter for manual erasure in accordance with the techniques identified in the first-mentioned patent. Thus, after stroking the erase key, in the event that the erroneously typed character is not found in line memory, the operator merely follows stroking the erase key by stroking the erroneously typed character key. Operation of the erase key in the event that the erroneously typed character is not found in the line memory, conditions the typewriter for manual erasure in which the operator must select the erroneously typed character so as to induce the erasure thereof.

Employing an automatic erasing typewriter of the present invention further improves the capabilities of such typewriter in other respects as well. In the automatically erasing typewriter disclosed in U.S. Pat. No. 3,780,846, when the operator strokes the erase key, and the typewriter finds a space function in the line memory, a second backspace is initiated, in effect, "looking" for an erasable character. Thus, if the typist is attempting to erase the "space", the automatically erasing typewriter requires the typist to either erase the immediately preceding character and begin typing at that point, or employ the backspace key rather than the erase key. In accordance with the present invention, when an erase operation is initiated, if the typewriter finds a space function in the associated line memory location, the backspace is terminated and the machine is conditioned for manual erasure. Operating the space bar then deconditions the typewriter from either an automatic or manual erase mode without causing an escapement to thereby enable the typist to continue typing to, in effect, "erase" the space by inserting a character therein.

Thus, in accordance with the invention, an automatically erasing typewriter which can type a sequence of characters on a page in response to operator actuation of a sequence of keys on the keyboard includes, key actuated means for generating signals representing an actuated key, memory means for storing an ordered sequence of signals representing a sequence of operator actuated keys, print means including print and erase media for executing a print cycle to at times print a character if said print medium is enabled, or to erase a character if said erase medium is enabled, print point position control means responsive to said key actuated means for displacing said print means and for accessing a selected location of said memory means corresponding to said print point, and erase means operative in response to actuation of an erase key for initiating a sequence of operations including:

(a) actuating said print point position control means to displace said print point toward a left margin, (b) accessing said memory means at a selected location corresponding to said print point for reading signals stored at said selected location, (c) actuating said print means and enabling said erase medium to execute a print cycle to erase a character at said print point corresponding to signals read from said memory means, wherein the improvement comprises:

means responsive to absence of signals representing an erasable character at said selected location of said memory means to inhibit said print cycle and to enable said erase medium media and said printing means to execute a print cycle on a following key actuation only if said following key actuation corresponds to actuation of a key representing an erasable character.

More particularly, in accordance with the present invention, when an erase key is stroked, a backspace is initiated which has the effect of displacing the print point one character space rearwardly. Moving the print point has two effects; firstly, the type carrier or print means is displaced corresponding to moving of the print point, and secondly, the line memory location addressed is also correspondingly displaced. In the event that the line memory contains a character code, a print cycle is initiated with the erase medium enabled and the automatic erase functon is carried out. In the event, however, that the line memory does not contain a character code, the typewriter print cycle is inhibited and instead the typewriter is conditioned to manually erase, in which, on the next keystroke, comprising an erasable character, manual erase is effected by initiating a print cycle with the erase medium enabled, inhibiting or preventing escapement of the print means and finally, deconditioning the typewriter from an erase mode. In the event that the operator strokes a key other than an erasable character, the typewriter either reinitiates the automatic erase sequence in the event that the subsequently struck key is the erase key, or merely deconditions the typewriter from an erase mode if the subsequently struck key is the space bar.

BRIEF DESCRIPTION OF THE DRAWING

The present invention will now be described in greater particularity so as to enable those skilled in the art to practice the same in conjunction with the attached drawing in which like reference characters identify identical apparatus, and in which.

DETAILED DESCRIPTION OF PREFERRED EMBODIMENTS

Figure 1:
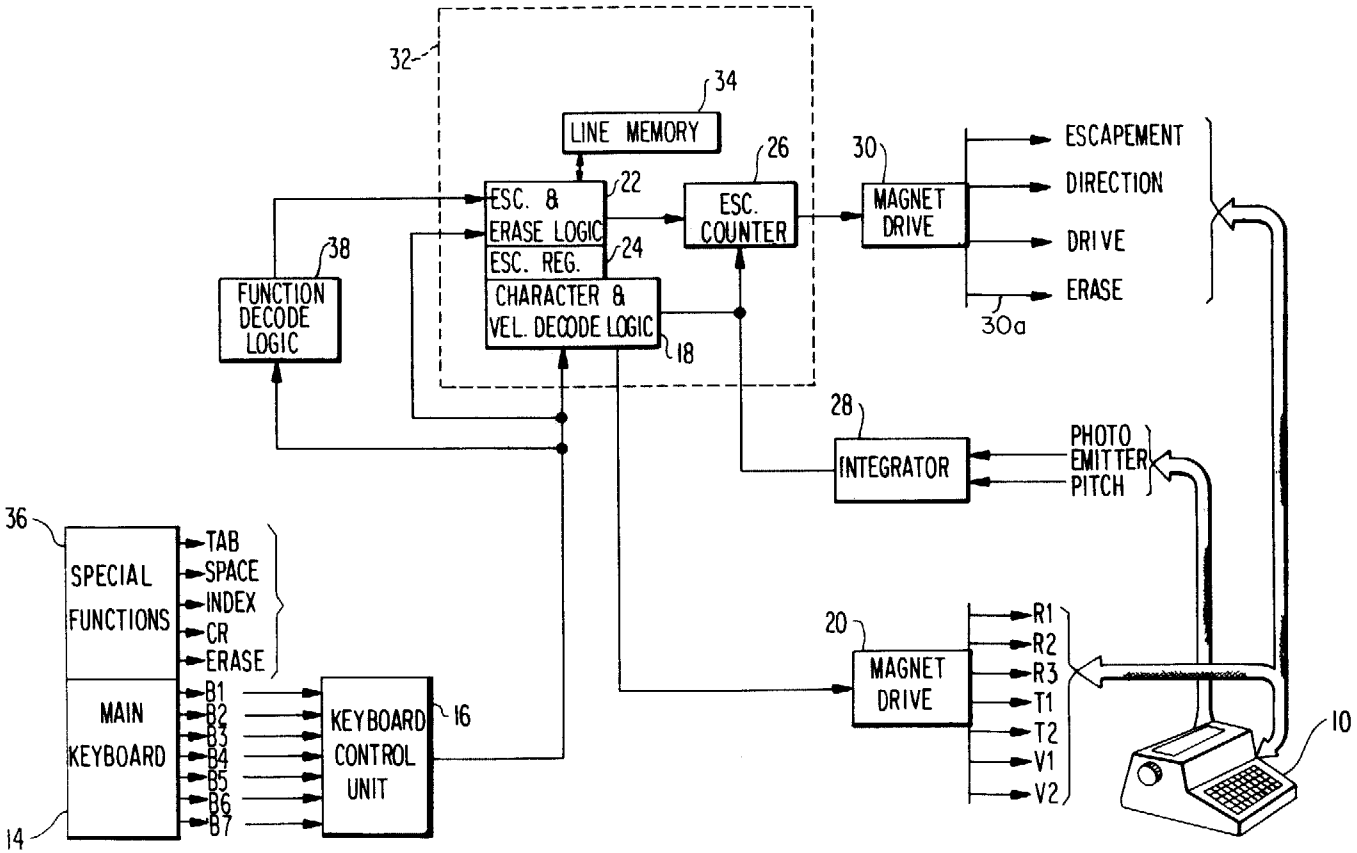
FIG. 1 is a block diagram of an electronically controlled typewriter which may implement the present invention.
Figure 2:
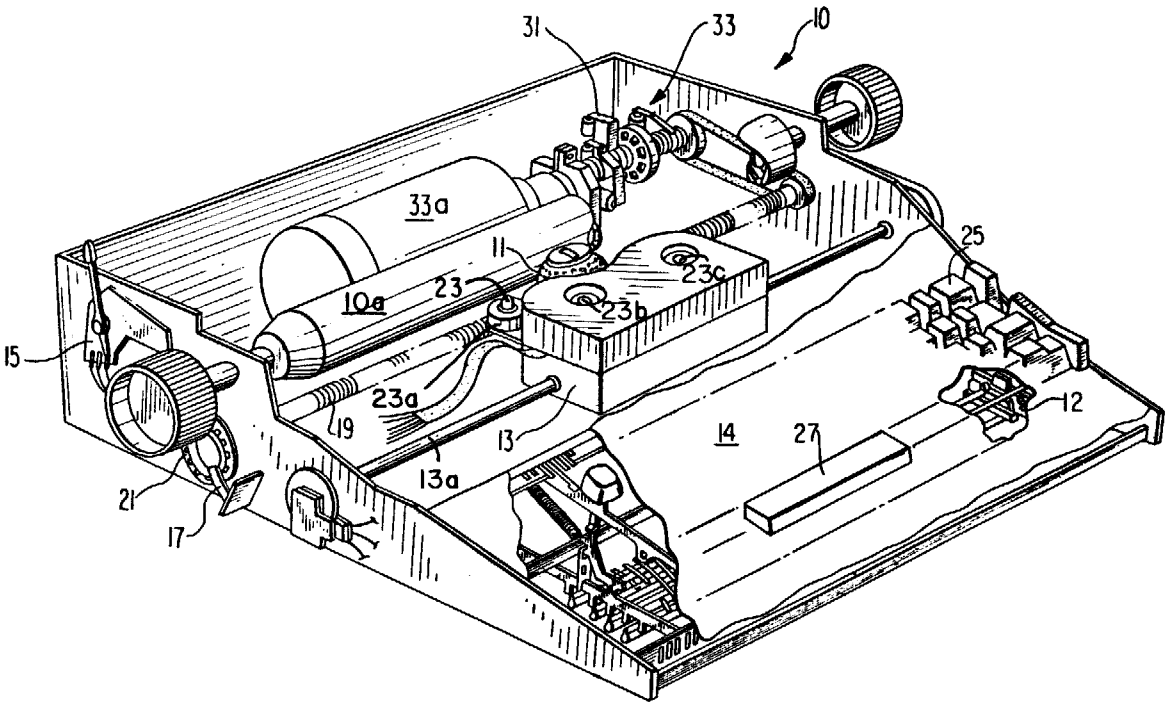
FIG. 2 is a partially broken-away view of the interrelation of the mechanical components of the typewriter of FIG. 1.

Referring to FIGS. 1 and 2, there is illustrated a typewriter 10 which is controlled by electronics in that the keyboard signals generated are processed electronically and the electronic controls therein then issue electronic commands to the printer to effect the appropriate functions of the printer elements to cause printing, escaping, backspacing, tabulation, correction and other normal printer functions. When a key lever 12 on the keyboard 14 is depressed to effect the selection of a character for printing, the keyboard 14 generates a predetermined signal pattern thereby transmitting signals from the keyboard 14 to the keyboard control unit 16. The keyboard control unit 16 captures the electronic inputs from bail codes B1 through B7 and generates an appropriate strobe or control signal which then causes the total data signals to be transmitted to the character and velocity decode logic 18. The character and velocity decode logic 18 then converts the signals from the keyboard control unit 16 into signals which represent the position on the print or type element 11 of the character selected by the key lever depression. This is accomplished by converting the keyboard control unit 16 signal into signals to magnet drivers 20 which then effect the rotation and the tilt of a single type element 11 or other conventional selection technique, to position the desired type font at the print point and then the selection of other controls such as the velocity with which that type font is propelled for imprinting. The magnet drivers 20 produce signals R1–R3 (rotate magnet) for rotation of the type element 11, signals T1–T2 for tilting of type element 11 and signals V1–V2 for control of impact velocity, as described in Bowles et al U.S. Pat. No. 4,245,918.

The keyboard control unit 16 signals are simultaneously read into the escapement and erase logic 22 which, then, through a conventional table look-up determines the assigned escapement values for each of the characters which are represented by the output of the keyboard control unit 16. These escapement values or widths may be a standard width such as for example using a 1/60th of an inch per unit, 6 units for a 10 pitch escapement of 5 units for a 12 pitch escapement. Additionally, with the escapement of characters being defined as units of 1/60th of an inch, it is possible to assign escapement values to characters proportional to their actual printing width, otherwise known as proportionally spaced characters. This provides the capability of escaping the typewriter 10 responsive to the keyboard control signals and effecting proportionally spaced character printing.

The position of the carrier 13 (see FIG. 2) or the print point defining means of the typewriter 10 is constantly stored in the escapement register 24 which is a portion of the escapement and erase logic 22, thereby providing a current location, measured from the leftmost point of travel of the print carrier 13, and this value is updated as the print carrier 13 translates left or right under the control of any of the keyboard signals. The escapement and erase logic 22 outputs the width of the characters which have been selected at the keyboard 14 to the escapement counter 26. This is necessary to provide a control over the escapement functions of the printer. The escapement counter 26 then stores on a temporary basis the information necessary to control the translation of the print carrier 13 over a predetermined or preselected distance. The escapement counter 26 is controlled in its operation by the signals emanating from integrator 28 which has input signals representing the output of a pitch selection switch 15 and the photoemitter/sensor 17 associated with the lead screw 19 and the escapement signals or emitter wheel 21 which indicates which portion of a rotation the lead screw 19 has been rotated through. The pulses created by the photoemitter/sensor 17 and wheel 21 on the end of the rotatable lead screw 19 of the typewriter 10 effect decrementing of the escapement counter 26. As long as the escapement counter 26 contains a numerical value, the photoemitter/sensor 17 will then pulse the escapement counter 26, through the integrator 28, and cause the escapment counter 26 to provide an output signal to the appropriate magnet drivers 30 to cause movement of the print carrier 13.

The escapement or movement of the print carrier 13 is a result of signals emanating from the magnet drivers 30 which are provided their input from the escapement counter 26. The escapement signal, the direction signal, the drive signal and the erase signal all emanate from the magnet drivers 30 which are controlled ultimately from the keyboard 14. The escapement magnet driver 30 causes the release of the lead screw 19 and thus allows its rotation together with the emitter wheel 21 which interacts with the photoemitter/sensor 17, thus creating the signals discussed above. The direction magnet drive 30 controls the engagement of the clutches 31 in the drive unit 33 to determine the forward or reverse direction of the carrier 13, by controlling the rotational direction of the lead screw 19. The drive magnet driver 30 provides the engagement or the coupling between the main drive motor **33*a* of the typewriter 10 and the lead screw 19, through the power transmission or drive unit 33**.

The erase magnet driver 30 controls the elevation, from its withdrawn position, of an erase medium or tape **23*a* (shown in FIG. 2 wound on a reel 23) so that any subsequent printing effected by the type element 11 causes the impacting of the erase medium 23*a* against the page to effect erasure, if the character being impacted was the same character as was previously impacted onto the printing ribbon or medium (wound on reels 23*b* and 23*c* of print carrier 13**) at that print point.

The printer control unit (or electronic control circuits or electronic controls) 32 contains the character and velocity decode logic 18, the escapement and erase logic 22, the escapement register 24, the escapement counter 26 and the line memory 34. As signals are decoded by the character and velocity decode logic 18 for subsequent utilization by the magnet drivers 20 for selection, that same information is temporarily stored in a memory designated as the line memory 34. This memory or register 34 is capable of receiving and storing data in the sequence in which it has been received. The line memory 34 is capable of being read in reverse to determine characters which have been previously printed and machine functions which have occurred during that particular line of operation, such as the initiation of a tabulation or space command.

Functions of the typeriter 10 are controlled by the function portion 36 of the keyboard 14. The functions which may be included in a typewriter 10 include tabulation, space, carrier return, shift, index and erase.

Of particular interest in this case is the erase function. As disclosed in U.S. Pat. No. 3,780,846, typewriter 10 is capable of automatic erase. In an automatic erase operation, three functions are performed in response to actuation of the erase key 25; firstly, the line memory 34 is interrogated for the present print point and determination is made as to whether or not an erasable character is found at that location. Assuming an erasable character is found, the erase medium **23*a* is enabled (or lifted) so that when a print operation occurs, the type element 11 will drive the erase medium 23*a* onto the page rather than the printing ribbon or print medium. If the type element 11 character which drives the erase medium 23*a* to the paper matches the character which is to be erased, the previously typed character is deleted, either by lifting off the ink deposit in the first print operation or by covering the ink so that it is not visible. Thus, with the erase medium 23*a* lifted, the character read from the memory 34 is employed to select a corresponding typeface and a print cycle operation is executed. As disclosed in the '846 patent, if memory 34 is empty or if an erasable character is not found at the preceding location, the typewriter 10** merely performs a backspace and then begins the sequence again.

Frequently, the line memory 34 will not contain an erasable character. This can occur if the operator, after typing a full or partial line, indexes the platen **10*a*. This has the effect of clearing the line memory 34, thus insuring that no erasable character will be found on subsequently interrogating line memory 34. If the operator has indexed the platen 10*a* to register it with a preceding line, while the line memory 34** will contain no erasable characters, the page will indeed contain erasable characters, and therefore, the operator may desire an erase operation to be performed.

A second instance when interrogation of the line memory 34 will reveal no erasable character occurs if the line memory 34 contains a space. If, for example, the operator has erroneously operated the space bar 27, and wishes to "erase" the space, the line memory 34 containing the space will not have an erasable character. In the '846 patent, in response to an erase command, the typewriter, in effect, skips the space and erases the immediately preceding character which may not be the operation desired by the operator.

Of course, if the line memory 34 does not contain signals representing the character to be erased, automatic erase operation is not possible. However, prior art typewriters are capable of what is termed a manual erase. In a manual erase, firstly, the print point is selected to correspond to the character to be erased (i.e., typically requiring a backspace function), the erase medium is enabled such that on a following depression of a character key, the typeface will impact the erase medium onto the paper, and if the character which had been struck corresponds to the character to be erased, it will be erased. Some typewriters, for example, are capable of the automatic erase function, and are also capable of implementing the manual erase operation. This is effected by engaging simultaneously the code key and the erase key which has the effect of "teaching" the typewriter to perform the manual erase function.

In accordance with the present invention, the electronic control circuits 32 of the typewriter 10 implement either the automatic erase function or the manual erase function, and the selection is made by the electronic control circuits 32 based upon the status of the line memory 34. In effect, if an automatic erase operation at the effective print location is possible, it will be performed. On the other hand, if the line memory 34 contains either a non-erasable character such as the space or function, or if the line memory 34 is empty, the electronic control circuits 32 will implement a manual erase. If the following keystroke is that of an erasable character, the manual erase operation will be performed. Otherwise, the electronic control circuits 32 either reinitiate automatic erase, if the following keystroke is the erase key 25, or simply decondition from manual erase if the following keystroke is neither an erasable character or the erase key 25.

For purposes of this application, an "automatic erase" is an erase function performed in response to selection of only the "erase" function without operator selection of the character to be erased. On the other hand, "manual erase" is an "erase" function in which the operator selects the character to be erased. Conditioning for a manual erase is a manual operation in which an erase latch 112 is set so that, on a following print cycle, the erase medium 23*a* is lifted and interposed between the type element 11 and paper. Correspondingly, deconditioning from manual erase corresponds to resetting the manual erase latch 112.

Upon the initiation of an erase command, the special function portion 36 of the keyboard 14, generates a signal which is passed through to the function decode logic 38 and decoded. The output of the function decode logic 38 is gated into the escapement and erase logic 22 which, in turn, recognizes that the function is an erase operation. The escapement and erase logic 22 accesses the line memory 34 to determine the character which was previously printed in the next leftmost character position from that of the present print point. If the line memory 34 has signals stored in that position corresponding to an erasable character, the automatic erase function is performed. On the other hand, if the character position accessed does not contain an erasable character or if the line memory 34 at that position is empty, the machine is conditioned for manual erase and awaits the next keystroke operation. If the next keystroke operation is a second actuation of the erase key 25, then the machine is deconditioned from manual erase operation and again begins a sequence of operations in attempting to perform an automatic erase operation. In the event that the subsequently actuated key is not the erase key 25, but is an erasable character, then the manual erase operation is performed. The operator is allowed to decondition the machine from manual erase and return it to its normal operating state by operation of the space bar 27. If, on the other hand, another function key is depressed, such as a tabulation function, index function, carriage return or shift, the function is performed, the machine is deconditioned from manual erase, and it returns to its normal operating state.

The block diagrammed control unit 32 of FIG. 1 is employed to implement the functions described above. The control unit 32 interfaces with the print carrier 13 and its drive through the magnet drivers 20 and 30. While the action of the control unit 32 may, with state of the art techniques, be operated at very high rates, printer operation, requiring, as it does, mechanical movements, is much more limited. Typical electronic typewriters on the market today have an operating cycle that has four distinct states. A first state is a rest or wait state. As a key is actuated and decoded, the typewriter shifts to a second state at which point the print cycle is initiated. Once the print cycle is begun, it must be completed in a fixed time frame since that time frame is fixed by the rotation of a shaft. Once the print cycle is concluded, the typewriter is in its third state. At this time, escapement may be performed. When escapement, or the time for escapement is concluded, the machine is in its fourth state. At this time, the various control signals which have controlled the print cycle and escapement are turned off and the machine returns to its original state. In response to various conditions the typewriter may skip various functions, for example, while the machine cycle always includes a time during which escapement is effected, in certain conditions no escapement actually occurs.

The automatic erase function typically requires two iterations of the four machine states. When actuation of the erase key 25 is decoded, the typewriter 10 has moved from a rest state to a second state. A print cycle is begun but no print operation occurs (i.e., a no-print cycle). At the conclusion of the print cycle an erase latch (see erase latch 61 in FIG. 1 of U.S. Pat. No. 3,780,846 has been set so that escapement is initiated and is accomplished as a backspace. At the conclusion of the escapement, the control signals are turned off and the machine is in a quasi-rest state, similar to a rest state except that the erase function is only partially complete, not only is an erase latch set but a second cycle latch 107 is set indicating that line memory interrogation has resulted in detection of an erasable character. On a second iteration of the machine states (which follows immediately after the first because the second cycle latch 107 is set) the print cycle is performed with the type element 11 controlled by signals read from the line memory 34 and thus erasure is effected. The escapement cycle is effectively skipped and, at the conclusion of the second iteration of the machine states, the automatic erase function is concluded. In accordance with the present invention, similar iterations of the same machine states are effected but the cycle in which type impact occurs is initiated only after the operator has selected the character to be erased.

In more detail, the typewriter 10 of the present invention initiates similar action in response to erase key depression as outlined immediately above. However, after the first print and escape cycles, while an erase signal from an erase latch is present, a manual erase latch 112 is set indicating the failure to find an erasable character in the interrogated line memory 34 location. With the manual erase latch 112 set, the machine returns to a wait state in which no further operation will be initiated until a further key depression is detected. When a further key depression is detected, the machine again goes through its various states coresponding to the first iteration of the machine states for automatic erase. On this second iteration, no printing or impacting occurs but instead, the printer is prepared for impacting in accordance with the operator's key selection and a second cycle latch 107 is set (assuming an erasable character is selected). Escapement is also inhibited and as this cycle terminates, a final or third cycle is begun since the second cycle latch 107 is set. On this final cycle, impacting and erasure occurs, escapement is again inhibited and all latches (e.g. 107, 112) are reset. If the operator has not selected an erasable character, the second cycle latch 107 is not set and thus, no impacting occurs on the final cycle; however, depending on the operator's selection, some or all of the latches (e.g. 107, 112) may be reset as will be described.

A preferred embodiment is implemented in the form of a programmed processor to implement the control unit 32, for example, a microprocessor, although it is within the scope of the invention to implement control unit 32 in the form of discrete logic or hard wired circuits.

In an embodiment of the invention which has been constructed the microprocessor used was an Intel 8048. Clearly, other microprocessors or digital processors could be utilized. Regardless of implementation, however, the flow diagram of FIGS. 3 and 4 illustrate the signal and logic flow.

Figure 3:
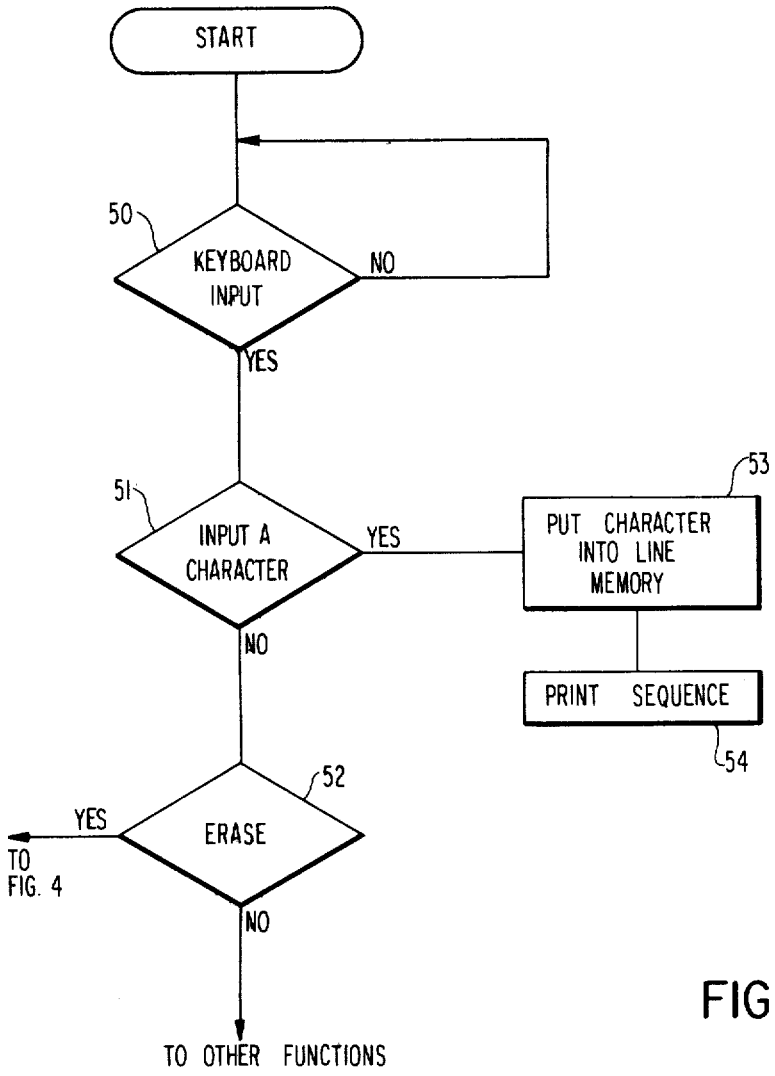
FIGS. 3 and 4 are logic flow diagrams illustrating the logic of the present invention.

As shown in FIG. 3, control unit 32 in its normal state awaits a keyboard input. When a keyboard input is detected at function 50, the character and velocity decode logic 18 determines, at function 51, whether or not the input corresponds to a character. If it is a character, functions 53 and 54 are performed to store the character in a line memory 34, and execute a print cycle wherein the character is printed on the paper at the present print point. The print sequence 54 includes a function to space (or escape) the print carrier 13 such that, at the conclusion of the normal print operation, the print point has moved to the next character location, ready for a following print sequence. This operation typically requires only a single iteration of the four machine states described above.

On the other hand, if the character and velocity decode logic 18 determine that the keyboard input was not a character, then the function decode logic 38, at function 52, determines whether an erase function has been commanded. If it has not, the function decode logic 38 checks for the existence of other function commands, which are not germane to the present invention and therefore are not described herein.

Figure 4:
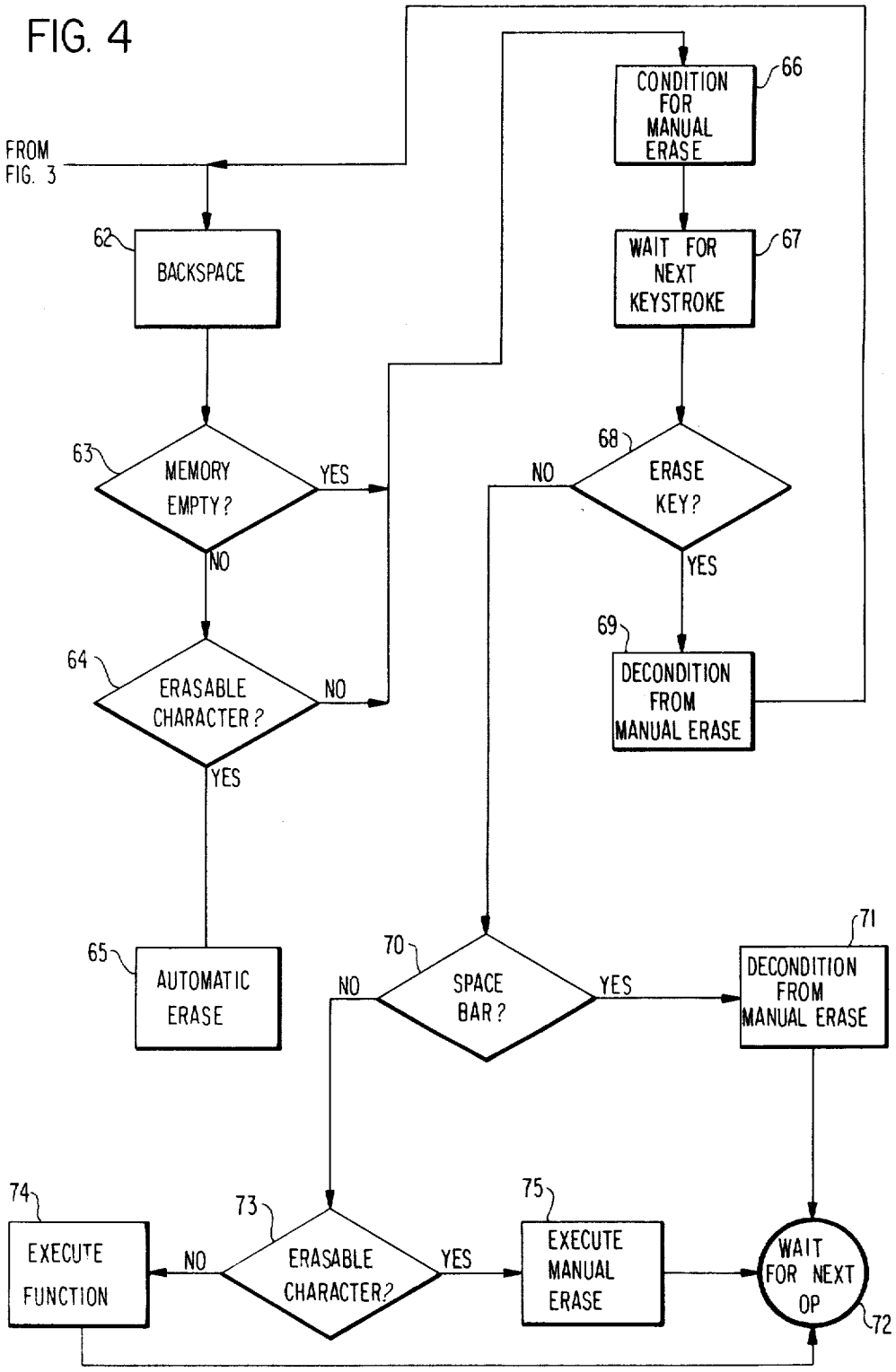

However, assuming that the function decode logic 38 recognizes an erase command, then the logic performed is illustrated in FIG. 4.

As shown in FIG. 4, the erase command is gated through the function decode logic 38 to the escapement and erase logic 22. A quantity is loaded into the escapement counter 26 which, as disclosed, for example, in application Ser. No. 908,315 operates to backspace the print carrier 13. Since the escapement register 24 is used to access the line memory 34, once the backspace operation is concluded, the escapement register 24 stores the location of the print point so it accesses line memory 34 at the "backspaced" location. The escapement and erase logic 22 interrogates the line memory 34 at function 63 to determine if the location accessed is empty. If it is not empty, then the escapement and erase logic 22 determines whether or not the signals stored in the line memory 34 correspond to an erasable character. If an erasable character is found, the second cycle latch 107 is set and the automatic erase function 65 is performed. Those functions are not disclosed in detail here since they are identified in U.S. Pat. No. 3,780,846. In brief compass, the erase medium **23*a* is enabled (lifted) by the magnet driver 30, and a print command is issued corresponding to the character found in the line memory 34**.

If, on the other hand, either at functions 63 or 64, the escapement and erase logic 22 determined that the memory location accessed was empty, or an erasable character was not found at the memory location, then the escapement and erase logic 22 conditions the typewriter 10 for a manual erase at function 66 (i.e., the manual erase latch 112 is set). This prepares the erase medium **23*a* for engagement on the conditions which are specified below. Once that operation has been performed, the escapement and erase logic 22 awaits the next keystroke at function 67. The preceding functions from depression of the erase key 25 up to function 66** correspond to a single iteration of the four machine states.

In the event that the next keystroke actuation is that of an erasable character, the keyboard control unit 16 sends the corresponding signals to the character and velocity decode logic 18. The same signals are received by the function decode logic 38 which determines that this keystroke actuation is not that of an erase key 25, i.e., function 68. Similarly, the function decode logic 38 determines that the next keystroke actuation was not a space bar 27, i.e., function 70. However, the character and velocity decode logic 18 determines that the next keystroke actuation was indeed that of an erasable character (function 73) which information is gated into the escapement and erase logic 22. While the machine cycles though the second cycle in which both print and escape functions are skipped, the second cycle latch 107 is set. On the final cycle, the character and velocity decode logic 18 formulates a print command to the magnet driver 20 which has the effect of rotating and tilting the type element 11, or other similar effects, depending upon the print apparatus employed in the typewriter 10. However, since the machine has previously been conditioned for manual erase (the manual erase latch 112) at function 66, the magnet driver 30 now energizes erase magnet drive line **30*a* to lift the erase medium 23*a*. Thus, at function 75, a manual erase operation is performed wherein the operator has selected the character, and the machine has lifted the erase medium 23*a* such that the type element 11 forces the erase medium 23*a* onto the paper to effect the erasure. Following the print cycle (in which erasure is effected), the machine is deconditioned from the manual erase mode, that is, the latches 107, 112** are reset.

If, on the other hand, an erasable character was not the next character key struck, but rather a function key was struck, then the decode logic 38 determines at function 74 that a function has been selected. This selected function is executed through the escapement and erase logic 22 in combination with the other apparatus necessary to perform the selected function. At the same time, the machine is deconditioned from manual erase.

If, rather than striking an erasable character or a function key, the operator has operated the space bar 27, then function decode logic 38 determines at function 70 that the next actuated key was the space bar 27. This information is gated to the escapement and erase logic 22. The effect of this operation is to decondition the typewriter 10 from manual erase (function 71) in that the previously prepared circuit for the erase magnet drive line **30*a* through the magnet driver 30** is eliminated.

Finally, if the operator has again actuated the erase key 25, as the next following key, then function decode logic 38 deconditions the machine from manual erase (function 69) by interrupting the previously prepared circuit for the erase magnet drive line 30a through magnet driver 30 and the sequence shown in FIG. 4 is repeated again starting at the backspace function 62. At the completion of functions 71, 74 or 75 the machine awaits a further operation (function 72).

Figure 5:
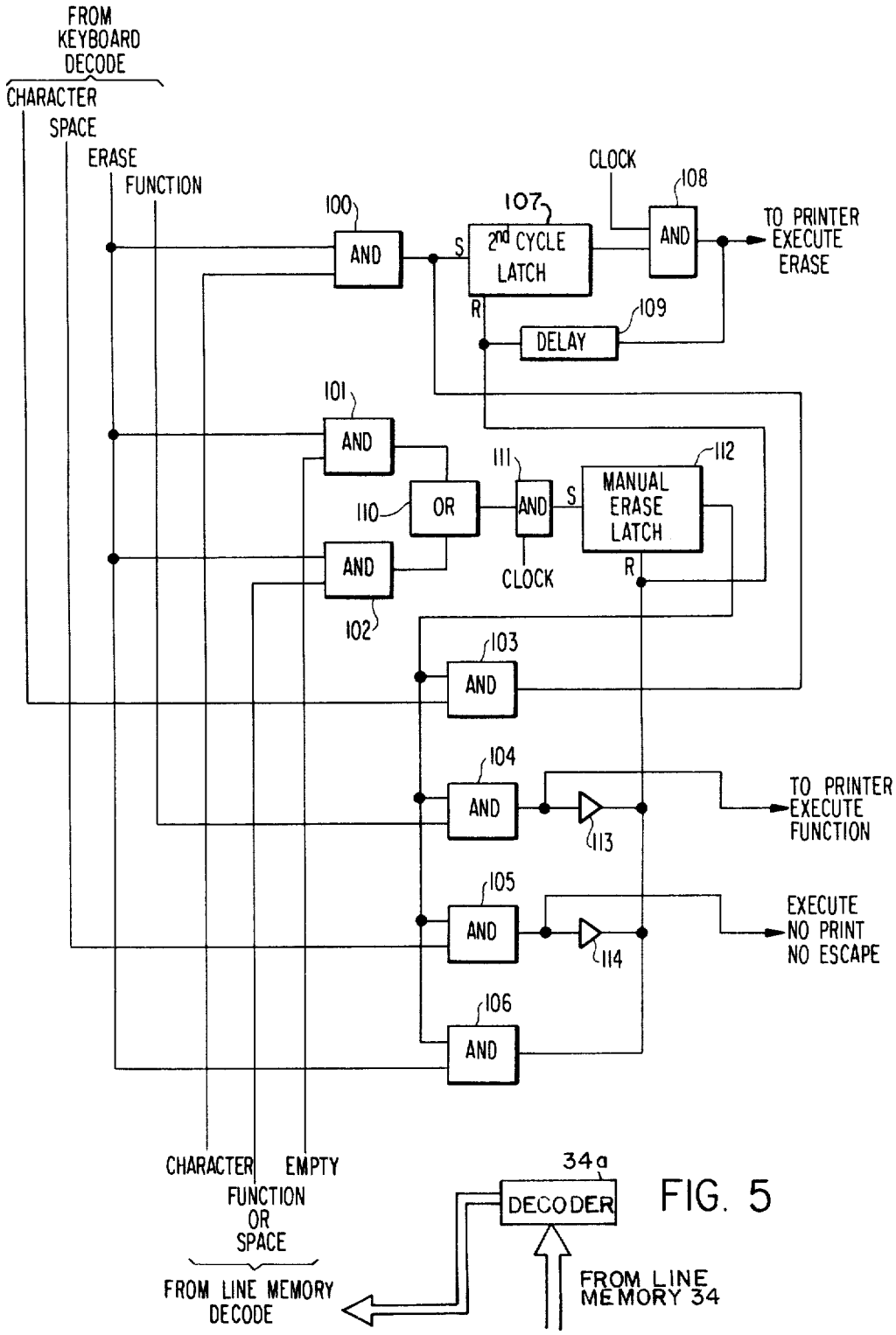
FIG. 5 is a schematic of a discrete logic circuit implementing the present invention.

FIG. 5 illustrates in detail the components of the erase and escape logic 22 required to implement one embodiment of the present invention. As shown in FIG. 5, the erase and escape logic 22 is provided with two sets of signal inputs, a first set from keyboard decode logic 38 and 18 identifying the actuation of a key corresponding to a character, space, erase or other function; and a second set of input signals from a decoding circuit 34a arranged to decode the addressed content of the line memory 34 corresponding to the print point, the second set including signals identifying a character, function, space or empty state of the memory location.

As is indicated in FIG. 4, the two sets of signals are supplied, in selected combinations to AND gates 100–102. AND gate 100, subjected to an input identifying an erase key actuation and a corresponding character decode from the line memory 34, provides an output to set the second cycle latch 107. At an appropriate clock time, the set output of latch 107 is coupled through further AND gate 108. The output of AND gate 108 is provided to the printer to cause execution of an erase cycle. The printer erase cycle includes a print cycle in which the erase medium 23a is enabled and impacted by the type element 11 onto the paper, and a skipped escape cycle. The same output of gate 108 is provided to a delay circuit 109, the output of which is arranged to reset the second cycle latch 107.

This operation corresponds to execution of the automatic erase function. Namely, the AND gate 100 detects the depression of an erase key 25 and the presence of a character in the relevant location in the line memory 34, and as mentioned above, the second cycle latch 107 is set so that at an appropriate time, the automatic erase function is executed.

In accordance with the present invention, however, AND gates 101 and 102 are provided, the first subjected to an input from the actuated erase key 25 and a corresponding decode of an empty location in the line memory 34. AND gate 102 is also subjected to an input derived from the depression of an erase key 25, with the corresponding decode from the line memory 34 corresponding to storage of a function command or space. The outputs of AND gates 101 and 102 are coupled to an OR gate 110. The output of either one of AND gates 101 or 102 indicates that an automatic erase function cannot be executed since an erasable character is not found at the corresponding print point in the line memory 34. An output of OR gate 110 is coupled to an AND gate 111, clocked at an appropriate time in the machine cycle to set a manual erase latch 112. As will be explained below, setting the manual erase latch 112 temporarily inhibits execution of a printer erase cycle. However, it should be recalled that, at the time the line memory 34 is interrogated, the print point has already been backspaced or escaped and therefore, the typewriter 10 is in condition to execute a manual erase depending upon the next key actuation. Setting the manual erase latch 112 puts the machine in a quasi-wait state, similar to a normal wait state except for the set condition of the manual erase latch 112.

The set output of the manual erase latch 112 provides an input to AND gates 103–106. The other input to AND gate 103 is provided from a character key actuation, and production of an output from AND gate 103 provides a setting input to the second cycle latch 107. Accordingly, when AND gate 103 produces an output, the printer will execute an erase cycle, comprising more particularly, causing an impact of the type element 11 in the print cycle, but with the erase medium 23a lifted. As shown in FIG. 5, the output of the delay circuit 109 is also arranged to reset the manual erase latch 112 so that at the conclusion of the erase cycle both the second cycle latch 107 and the manual erase latch 112 are reset.

AND gate 104 has a second input provided from a decoded function key actuation, and the output of AND gate 104 is coupled to the printer to execute the selected function. The same output, coupled through a buffer 113, resets the manual erase latch 112.

The other input to AND gate 105 is provided by a decoded spacer bar 27 actuation, and the output of the gate 105 is provided to the printer which causes a no print no escape cycle, and the same output, coupled through buffer 114 is provided to reset the manual erase latch 112.

Finally, AND gate 106 has a second input provided by the decoded erase key actuation, and the output of AND gate 106 is provided to reset the manual erase latch 112.

A comparison of the logic of FIG. 5 with the flow chart of FIG. 4 will illustrate that the functions performed by this discrete logic circuit are substantially the same as that shown in FIG. 4.

The clock inputs to AND gates 108 and 111 can be replaced by other state-determining signals in the typewriter 10 as will be apparent to those skilled in the art. The only requirements are that, for example, once the second cycle latch 107 is set, the other electronic components should be allowed to settle so that the signals provided to the printer for the erase cycle are not indeterminate. The clocking function at AND gate 111 is provided to prevent a race condition at the manual erase latch 112. In the event that a reset signal is produced by depression of an erase key 25 when the manual erase latch 112 is set, the clocking function is arranged to insure that the resetting of the manual erase latch 112 occurs prior to the setting of the latch 112 so that when the erase key 25 is depressed, the manual erase latch 112 is maintained set in the event that the decoded contents of the line memory 34 correspond to either an empty location or a function command. Similar function is performed by the delay circuit 109, and those skilled in the art will appreciate that other apparatus or signals for delaying the resetting of second cycle latch 107 can be employed, for example, other machine-state determined signals.

As has been mentioned above, however, the preferred embodiment of the invention employs a stored program processor, preferably a microprocessor.

Appendices A, B and C, attached hereto, illustrate the program instructions (or code) used in a preferred embodiment of the invention incorporating the logic previously described herein. Appendices A and B comprise the code itself, including a series of statements listed in the column entitled "Statement". The remaining portions of Appendices A and B, consisting of the column labelled "Source" and the material to the right of the column labelled "Statement" are explanatory material helpful in understanding functions performed by the program instructions. Appendix C identifies the meaning of several of the statements to enable the reader to more readily comprehend the subject matter of Appendices A and B. It should be apparent to those skilled in the art that Appendices A and B are but portions of the program instructions used to control a typewriter 10 implemented in accordance with this invention, but capable of other functions not directly pertinent to the invention, and therefore, there are other collections of code referred to which are not directly pertinent to the instant invention.

In more detail, Appendix A is the collection of codes which is referred to when the typewriter 10 recognizes that the erase key 25 has been struck. On the other hand, Appendix B is a portion of the code which is referred to when the typewriter 10 recognizes a printable character has been struck. These two code collections are interrelated. Note, for example, that the instruction located at L33 includes a jump to L11 which is found in Appendix B (in the column labelled "Source"). Likewise, the first instruction of Appendix B "JB4" is a conditional jump to L502, and L502 is found in Appendix A.

Briefly, when an erase key 25 is struck, a carry bit is set and the printer buffer pointer PBP (Appendix C) is decremented. This operation results in the printer buffer pointer PBP (Appendix C) pointing at the memory location corresponding to the key depressed prior to actuation of the erase key 25. After the ID word is examined, a conditional jump results in a jump if the ID word indicates that a printable character was not found. The jump is to location L500. The instruction at L500 sets the manual erase flag. The following instruction at L503 turns on the bit which controls the backspace operation and then jumps to L17. L17 is also found in Appendix A, and one of the functions of this instruction is to set the keyboard buffer pointer KBP (Appendix C) to the printer buffer pointer PBP (Appendix C). The next instruction, L30, sets bits for no escape and no print. Instruction L33 includes a jump to L11 which is found in Appendix B. This instruction is the output instruction which causes the various control bits to be effective and the printer is thereafter controlled. Accordingly, in the event that the typewriter 10 was responding to depression of an erase key 25, and the memory 34 did not include an erasable character, the cycle of the print shaft 13*a* which is initiated with instruction L11, results in a no print, no escape, and the only significant event accomplished in this operation of code is setting of the manual erase flag.

In the event that a manual erase flag is set, and the operator strikes a printable character, the code at Appendix B is entered. The first instruction includes a jump to L502 if the manual erase flag is set (L502 is found in Appendix A). The first few statements L502 insure that the case is properly selected if the character case is different from the case which would otherwise be printed to insure that upon printing, the printed case agrees with the keyboard selected character case. The next instruction, L506, turns on the erase flag, and then the instruction string, starting at L17, is executed which terminates at L11 (Appendix B). This first pass through the code, entered when a printable character is struck with the manual erase flag set, has the effect of turning on the erase flag, but in other respects, rotation of the print shaft 13*a* which is initiated at L11 is again a no print, no escape cycle. The next cycle of the print shaft 13*a* will be the cycle in which the type element 11 is driven toward the paper for imprinting the character keyed by the operator. With the erase flag on, (at L506) the type element 11 will be driven into the erase medium 23*a* to effect an erase operation.

From the foregoing, it should be apparent that the code shown in Appendices A and B is effective to set a manual erase flag if the erase key 25 is actuated and the relevant buffer position does not contain a printable character. The code also illustrates that actuation of a printable character with the manual erase flag set will inhibit normal printing operation and instead result in an erase function.

Two examples will illustrate the operation. Assume that the following text is printed on a page:

ABC DEF GHIJKLMN

Assume the next keystroke is an erase key 25. When the electronics 32, 38 recognize the erase stroke, i.e., function 52 (FIG. 3) a backspace cycle is executed (function 62) and then the line memory 34 is interrogated (function 63, 64). If the memory 34 does contain an erasable character, it is automatically erased (function 65). So long as the erase key 25 remains depressed, or is continually depressed the characters up to the letter G are erased in this fashion.

After the erase of the letter G, the next depression of the erase key 25 performs the same functions except that at function 64, the electronics 32, 38 recognize that an erasable character is not in the line memory 34. Accordingly, at function 66, the typewriter 10 conditions itself for manual erase, and at function 67 awaits the next keystroke. If the next keystroke is an erase key 25, this is recognized by the electronics 32, 38, the previously effected conditioning for manual erase is deconditioned, and a return is made to function 62 to initiate a further backspace. Since all other conditions are the same, the letter F is erased.

If we assume that having erased the letter N through the letter G the operator wishes to delete the space and continue typing, adjacent the letter F the operator depresses the erase key 25 following the erase of the letter G. As mentioned above, the typewriter 10 conditions itself for manual erase and awaits the next keystroke. If the next keystroke is operation of the space bar 27, the resulting function performed by the electronics is to merely decondition the typewriter 10 for manual erase and await the next keystroke. Since this deconditioning does not result in the escape function, the next keystroke is the text that the operator desired to place adjacent the letter F.

If we assume that the text shown above is typed, but that for some reason, the line memory 34 does not contain signals representing these characters, for example, because the operator has moved the platen 10*a* following typing and has then relocated the platen 10*a* to the text above, actuation of the erase key 25 will result in a determination, at function 63, that the memory 34 is empty. The machine then conditions itself for manual erase and awaits the next keystroke. If the next keystroke is an N, a print cycle is performed but with the machine conditioned for manual erase, the medium employed is the erase medium 23*a* rather than the printing ribbon and therefore, the letter N is erased.

It should be apparent from the foregoing that the improved typewriter 10 is capable of initiating either an automatic or manual erase, on actuation of the erase key 25. If line memory 34 contains an erasable character at the immediately preceding print point, that character is automatically erased. If the immediately preceding print point contains signals which do not correspond to a printable character, then the typewriter 10 is conditioned for manual erase. The manual erase is effected if the next following keystroke is that of a printable character.

APPENDIX A

| Source | Statement | | |
|---|---|---|---|
| Erase | Org | | |
| | | | Note-Carry was cleared in Start routine |
| | CPL C | | Set C=1 to indicate erase |
| Backsp | Call | DECBPT | Decrement PBP |
| | Call | IDWRD | Get the ID Word |
| | CPL A | | |
| | ANL A, | B00000111 | Jump if not a printable character |
| | JNZ | L500 | |
| | Call | Case | Set Fo to indicate keycode case |
| | Call | DKITST | Jump if a dead key |
| | JF1 | L501 | |
| | JNC | L504 | Jump if backspace |
| | MOV R5, | B01000000 | Turn on Lv Mag Bit (for a backspace) |
| L502 | Call | Case | Case returns with bit 7 of "A" set to 1 if keycode case and ball case are not equal |
| | CPLA | | |
| | JB7 | L506 | Jump if keycode and ball case are equal |
| | Call | Shift | Compliment PUC flag, turn on R2 Magnet bit (for a shift) |
| L506 | SEL RBO | | |
| | MOV A, R3 | | Turn on erase flag |
| | ORL A, | B00000010 | (R3 bit 1) |
| | MOV R3, A | | |
| | SEL RB1 | | |
| L17 | Call | KPBP | Set KBP=PBP |
| | Call | CLRDKE | Clear 'Disable keyboard entries flag |
| L30 | CLR F1 | | Set F=1 for No Escape |
| | CPL F1 | | |
| | ORL P2, | B11110000 | Turn on bit for N.P. Magnet |
| L33 | MOV A, R5 | | Get the selection magnet code from R5 |
| | JMP | L11 | Turns on 'CC' and selection magnets and Turns on the cycle started flag |
| L501 | JC | L502 | Jump if erase |
| L507 | Call | DECBPT | Decrement the PBP |
| | JMP | L17 | |
| L500 | JNC | L505 | If erase set the ME flag |
| | MOV R6, | B00000001 | |
| L505 | XRL a, | B00000110 | Jump if not space |
| | JNZ | L503 | |
| L504 | Call | DECBPT | Decrement the PBP |
| L503 | Mov R5, | B01000000 | Turn on LV Mag bit (for a backspace) |
| | JMP | L17 | |
| | END | | |

APPENDIX B

| Source | Statement | | |
|---|---|---|---|
| PRNT | ORG | | |
| | MOV A, R6 | | |
| | JB4 | L502 | Jump if the ME flag was set (Test MET Flag) |
| | Call | Case | 'Case' returns with FO=1 for lower case OR FO=0 for upper case and bit 7 of 'A' |
| | JB7 | RKSFT2 | Set to 1 if keycode case and ball case are not equal Jump to RKSFT2 if the keycode case does not equal the ball case |

APPENDIX B-continued

| Source | Statement | | |
|---|---|---|---|
| | Call | DK1TST | Set F1=1 if Dead key |
| LVTST | MOV R1, | H17 | (Keyminder byte for MV2 key) |
| | MOV A,@R1 | | Jump if MV2 keyminder bit is |
| | CPL A | | Clear (MV2 Key depressed) |
| | JBO | LVEL | (Keyminder bit for MV2 key) |
| | MOV R1 | H11 | (Keyminder byte for MV1 key) |
| | MOV A R1 | | Jump if MV1 keyminder bit is |
| | CPL A | | clear (MV1 key depressed) |
| | JBO | LVEL | (Keyminder bit for MV1 key) |
| | Call | MAGWRD | Get the magnet code word |
| | JFO | L11 | Jump if lower case |
| | JBO | LVEL | Jump if LV2 bit is set |
| HVEL | Call | MAGWRD | Clear LV magnet bit in |
| | ANL A, | B10111111 | Magnet code word |
| | JMP | L11 | |
| LVEL | Call | MAGWRD | Set LV magnet bit in |
| | ORL A, | B01000000 | Magnet code word |
| L11 | ORL A, | B00000001 | Set the CC bit on |
| | OUTL BUS,A | | Output to the selection magnets |
| | SEL RBO | | |
| | MOV A, R2 | | Turn on the cycle |
| | ORL A, | B10000000 | started flag |
| | MOV R2, A | | |
| | RETR | | |
| | END | | |

APPENDIX C

| | |
|---|---|
| ERASE | Entered on Decode of erase key actuation |
| PBP | Printer buffer pointer |
| IDWRD | a word in buffer or line memory identifying the type of entry, such as printable character, function, space, etc. |
| CPL | Complement |
| C | Carry bit of accumulator |
| KBP | Keyboard buffer pointer |
| ANL | AND Latch |
| ORL | OR Latch |
| A | Accumulator |
| DECBPT | Collection of code to decrement PBP |
| CASE | Collection of code to compare keycode and ball case |
| SHIFT | Collection of code to Control shift magnet control bit |
| N.P. | No print |
| ME | Manual erase flag |
| JNC | Jump if not carry |
| JMP | Jump |
| XRL | Exclusive OR latch |
| JNZ | Jump if not zero |
| PRNT | Collection of code entered when a key corresponding to a printable character is struck |
| CC | bit, when set, turns on the cycle clutch to rotate the print shaft |

What is claimed is:

1. In an erasing typewriter including key actuated means for generating signals representing an actuated key, memory means for storing an ordered sequence of signals representing a sequence of operator actuated keys, print means including print and erase media for executing a print cycle to at times print a character at a print point if said print medium is enabled, or to erase a character at a print point if said erase medium is enabled, print point position control means responsive to said key actuated means for displacing said print means and for accessing a selected location of said memory means corresponding to said print point, and erase means operative in response to actuation of an erase key for initiating a sequence of operations including:

(a) actuating said print point position control means to displace said print point one character space toward a left margin, (b) accessing said memory means at a selected location corresponding to said displaced print point for reading signals stored at said selected location, (c) actuating said print means and enabling said erase medium to execute a print cycle to erase a character at said print point corresponding to signals read from said memory means, the improvement comprising:

first means responsive to absence of signals representing an erasable character at said selected location of said memory means to inhibit said print cycle and to enable said erase medium and said print means to execute a print cycle on a following key actuation only if said following key actuation corresponds to actuation of a key representing an erasable character.

2. The apparatus of claim 1 in which said first means includes latch means set to a distinctive condition only when said erase key is actuated and said selected location of said memory means does not contain an erasable character.

3. The apparatus of claim 2 which includes input means to set said latch means if said memory means contains signals representing a typewriter function or is empty at said selected location.

4. The apparatus of claims 2 or 3 which includes logic means distinctively operated in response to depression of a printable character key when said latch means is set to execute an erase function and to reset said latch means.

5. The apparatus of claims 2 or 3 which includes logic means distinctively operated if a typewriter function key is depressed when said latch means is set to execute a corresponding function and to reset said latch means.

6. The apparatus of claims 2 or 3 which includes logic means distinctively operated if a typewriter space bar is depressed when said latch means is set to execute a no print, no escape cycle and to reset said latch means.

7. The apparatus of claim 2 or 3 which includes logic means distinctively operated if said erase key is depressed when said latch means is set to initiate an automatic erase cycle and to reset said latch means.

* * * * *